US008151390B2

(12) United States Patent
Wang et al.

(10) Patent No.: US 8,151,390 B2
(45) Date of Patent: Apr. 10, 2012

(54) INFLATABLE BED HAVING AIR CHAMBERS INFLATABLE INDIVIDUALLY BY AN ELECTRIC AIR PUMP UNIT

(75) Inventors: Cheng-Chung Wang, Taipei (TW); Kenneth Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 0 days.

(21) Appl. No.: 13/274,219

(22) Filed: Oct. 14, 2011

(65) Prior Publication Data

US 2012/0036645 A1 Feb. 16, 2012

Related U.S. Application Data

(60) Division of application No. 12/723,519, filed on Mar. 12, 2010, now Pat. No. 8,051,517, which is a continuation of application No. 11/937,655, filed on Nov. 9, 2007, now Pat. No. 7,739,763.

(30) Foreign Application Priority Data

Nov. 10, 2006 (CN) ..... 2006 1 0148452

(51) Int. Cl.
*A47C 27/10* (2006.01)

(52) U.S. Cl. ..... 5/706; 5/710; 5/713

(58) Field of Classification Search ..... 5/706, 708, 5/710, 713, 738–740
See application file for complete search history.

(56) References Cited

U.S. PATENT DOCUMENTS

| | | | |
|---|---|---|---|
| 3,394,415 | A | 7/1968 | Parker |
| 5,509,154 | A | 4/1996 | Shafer et al. |
| 5,606,756 | A | 3/1997 | Price |
| 6,409,478 | B1 | 6/2002 | Carnes et al. |
| 6,721,980 | B1 | 4/2004 | Price et al. |
| 6,783,330 | B2 | 8/2004 | Carnes et al. |
| 6,868,569 | B2 | 3/2005 | VanSteenburg |
| 6,928,681 | B1 | 8/2005 | Stacy |
| 8,024,830 | B2 | 9/2011 | Wang et al. |

*Primary Examiner* — Fredrick Conley

(57) ABSTRACT

An inflatable bed includes a bedstead assembly, a mattress assembly, and an electrical air pump unit. The mattress assembly is disposed on and above the bedstead assembly, and includes a top sheet, a bottom sheet disposed under the top sheet, and a plurality of surrounding sheets interconnecting the top and bottom sheets to form a plurality of air chambers, which are not in fluid communication with each other. Each of the air chambers is defined among the top sheet, the bottom sheet, and a respective one of the surrounding sheets. The electrical air pump unit is disposed on the bedstead assembly, and is operable to inflate the air chambers individually so that air pressures in the air chambers may be different.

5 Claims, 14 Drawing Sheets

INFLATABLE BED HAVING AIR CHAMBERS INFLATABLE INDIVIDUALLY BY AN ELECTRIC AIR PUMP UNIT

CROSS-REFERENCE TO RELATED APPLICATION

This application is a divisional of U.S. application Ser. No. 12/723,519, filed Mar. 12, 2010, which is a continuation of U.S. application Ser. No. 11/937,655, filed Nov. 9, 2007, the entire disclosures of which are hereby incorporated by reference.

This application claims priority of Chinese Application No. 200610148452.X, filed on Nov. 10, 2006.

BACKGROUND OF THE INVENTION

1. Field of the Invention

This invention relates to an inflatable bed, and more particularly to an inflatable bed having a plurality of air chambers that can be inflated individually by an electric air pump unit.

2. Description of the Related Art

A conventional inflatable bed includes a plurality of interconnected mattresses for supporting the head and the body of the bed occupant. The mattresses can be inflated simultaneously by an electric air pump. As a result, the mattresses have the same softness at all areas of the inflatable bed. To enhance user comfort, however, it is necessary for such mattresses to provide different levels of softness at different areas of the inflatable bed.

SUMMARY OF THE INVENTION

The object of this invention is to provide an inflatable bed mattress assembly having a plurality of air chambers that can be inflated individually by an electric air pump unit.

According to this invention, an inflatable bed includes a bedstead assembly, a mattress assembly, and an electrical air pump unit. The mattress assembly is disposed on and above the bedstead assembly, and includes a top sheet, a bottom sheet disposed under the top sheet, and a plurality of surrounding sheets interconnecting the top and bottom sheets to form a plurality of inflatable air chambers, which are not in fluid communication with each other. Each of the air chambers is defined among the top sheet, the bottom sheet, and a respective one of the surrounding sheets. The electrical air pump unit is disposed on the bedstead assembly, and is operable to inflate the air chambers individually so that air pressures in the air chambers may be different to enhance user comfort.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
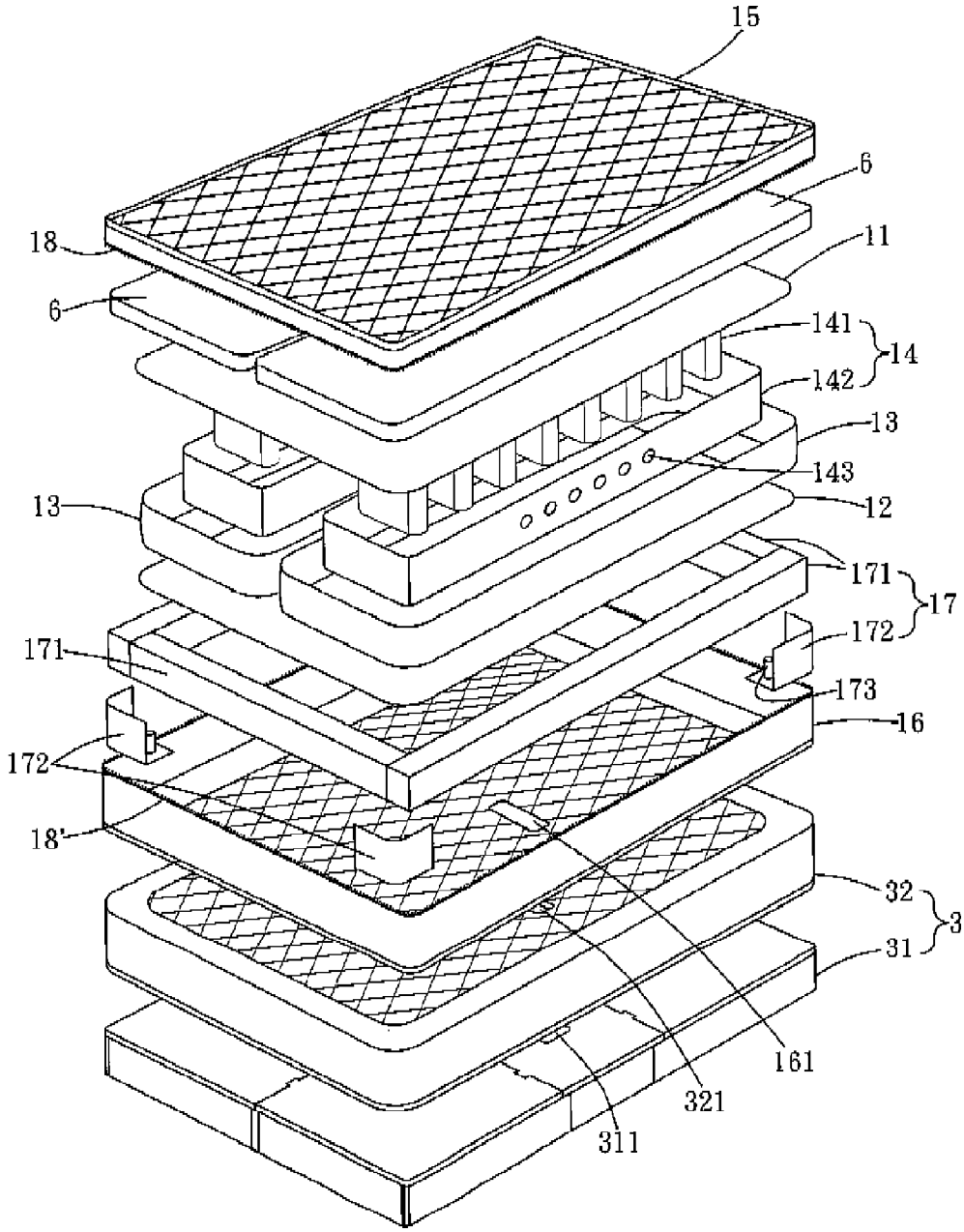
FIG. 1 is a fragmentary exploded perspective view of the first preferred embodiment of an inflatable bed according to this invention, wherein an electric air pump unit is removed.

Before the present invention is described in greater detail in connection with the preferred embodiments, it should be noted that similar elements and structures are designated by like reference numerals throughout the entire disclosure.

Figure 2:
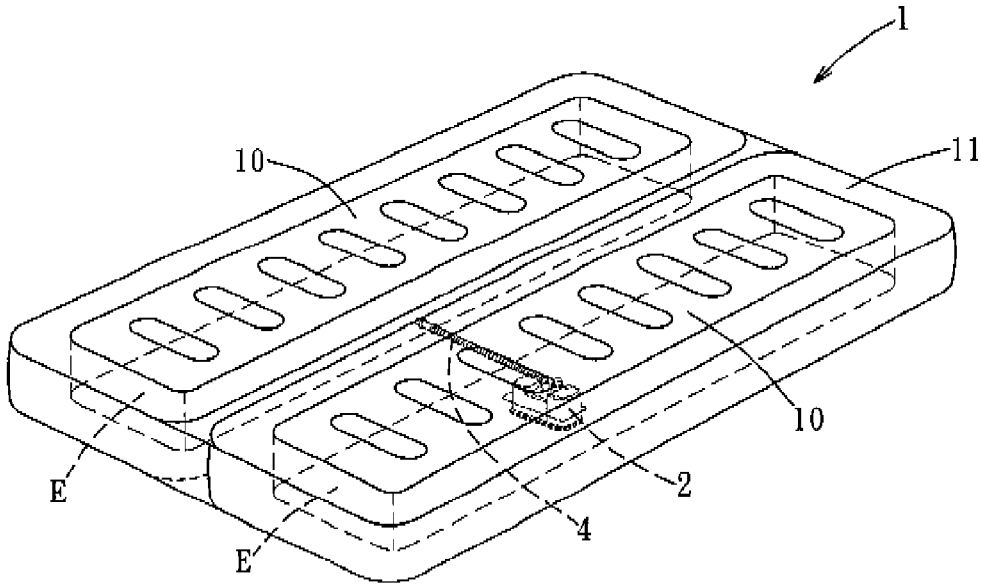
FIG. 2 is an assembled perspective view of a mattress assembly and the electric air pump unit of the first preferred embodiment.

Referring to FIGS. 1 and 2, the first preferred embodiment of an inflatable bed according to this invention includes a mattress assembly 1, a covering unit, an electric air pump unit 2, a bedstead assembly 3, and a cushion unit consisting of two cushion members 6.

The mattress assembly 1 includes a rectangular top sheet 11, a rectangular bottom sheet 12, two juxtaposed surrounding sheets 13 interconnecting the top and bottom sheets 11, 12 to define two air chambers (E) that are not in fluid communication with each other, and two reinforcing units 14 disposed respectively within the air chambers (E). When inflated fully, the air chambers (E) have the same shape and volume. As such, the mattress assembly 1 has two mattresses 10 each including a respective one of the surrounding sheets 13 and defining a respective one of the air chambers (E). Each of the mattresses 10 may be used to support one person. Each of the air chambers (E) is defined among the top and bottom sheets 11, 12 and the corresponding surrounding sheet 13. Each of the reinforcing units 14 includes a row of pull belts 141 and a surrounding belt 142 disposed around the row of pull belts 141 and formed with a plurality of vent holes 143 therethrough. Each of the pull belts 141 and the surrounding belts 142 is connected fixedly to the top and bottom sheets 11, 12.

Figure 1A:
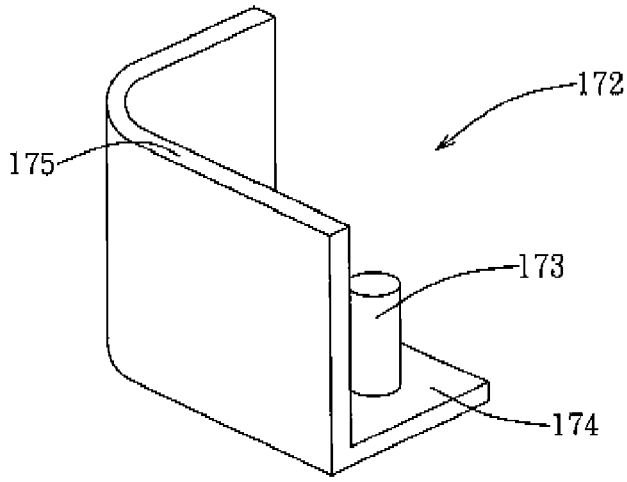
FIG. 1A is a perspective view of a corner positioning member of the first preferred embodiment.

The top and bottom sheets 11, 12, the surrounding sheets 13, and the reinforcing units 14 are received within the covering unit. The covering unit includes an upper covering member 15, a lower covering member 16, and a surrounding member 17. The upper and lower covering members 15, 16 are interconnected by a zipper unit. The zipper unit consists of upper and lower zipper halves 18, 18' attached respectively to the upper and lower covering members 15, 16 and interconnected removably. The cushion members 6 are disposed between the upper covering member 15 and the top sheet 11. The bedstead assembly 3 includes a rectangular bedstead body 31 and a cover 32 for covering the bedstead body 31. The surrounding member 17 includes four sponge bars 171 arranged to form a rectangular frame disposed within the covering unit between the upper and lower covering members 15, 16, and four corner positioning members 172 (only three are shown in FIG. 1) for supporting four corners of the rectangular frame, respectively. Each of the corner positioning members 172 is disposed between the upper and lower covering members 15, 16, and is formed with an integral positioning post 173 inserted into a hole (not shown) in the corresponding sponge bar 171. With further reference to FIG. 1A, in this embodiment, each of the corner positioning members 172 has a horizontal rectangular bottom plate portion 174 and an L-shaped plate portion 175 extending upwardly from two adjacent sides of the bottom plate portion 174. Each of the positioning posts 173 extends upwardly from the bottom plate portion 174 of the corresponding corner positioning member 172. The lower covering member 16, the bedstead body 31, and the cover 32 have respectively two aligned holes 161, 311, 321 formed therethrough. The electrical air pump unit 2 is received within the holes 161, 321 in the lower covering member 16, the bedstead body 31, and the cover 32, is disposed under and in fluid communication with one of the air chambers (E), and is in fluid communication with the other air chamber (E) via an air tube 4 (see FIG. 2).

Figure 3:
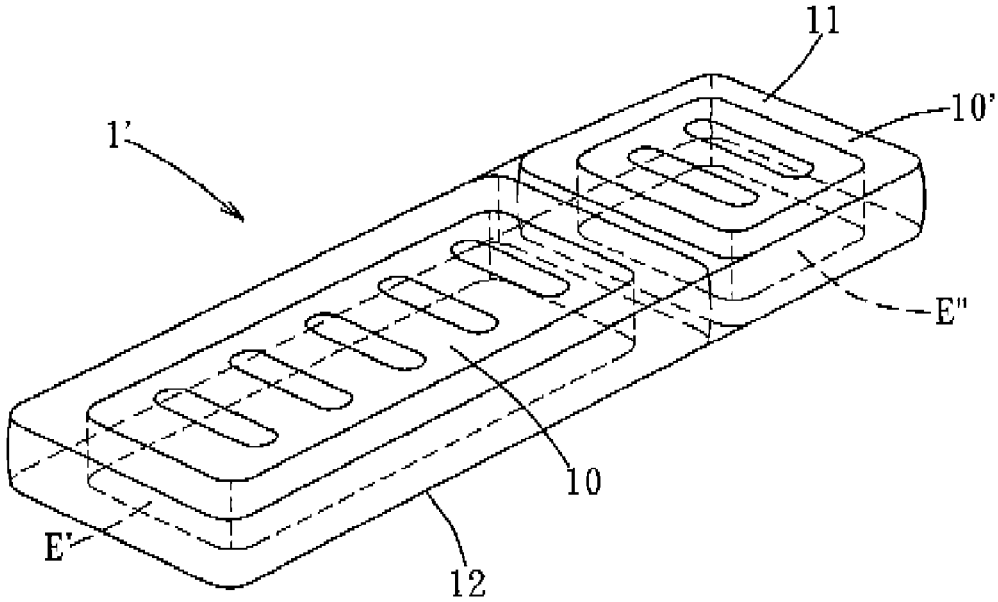
FIG. 3 is an assembled perspective view of a mattress assembly of the second preferred embodiment of an inflatable bed according to this invention.

Referring to FIG. 3, the second preferred embodiment of this invention is similar in construction to the first preferred embodiment. In this embodiment, a first modified mattress assembly 1' also includes a top sheet 11, a bottom sheet 12, two surrounding sheets (not shown), and two reinforcing units (not shown). The top and bottom sheets 11, 12 cooperate with the surrounding sheets to define a large air chamber (E') and a small air chamber (E") that are not in fluid communication with each other. When inflated fully, the volume of the large air chamber (E') is greater than that of the small air chamber (E"). The reinforcing units are disposed respectively within the large and small air chambers (E', E"). The surrounding sheets are disposed respectively around the reinforcing units. As such, the mattress assembly 1' has a large mattress 10 and a small mattress 10'. Each of the large and small mattresses 10, 10' includes a respective one of the surrounding sheets, and defines a respective one of the large and small air chambers (E', E"). The large and small mattresses 10, 10' are used to support the body and head of one person, respectively.

Figure 4:
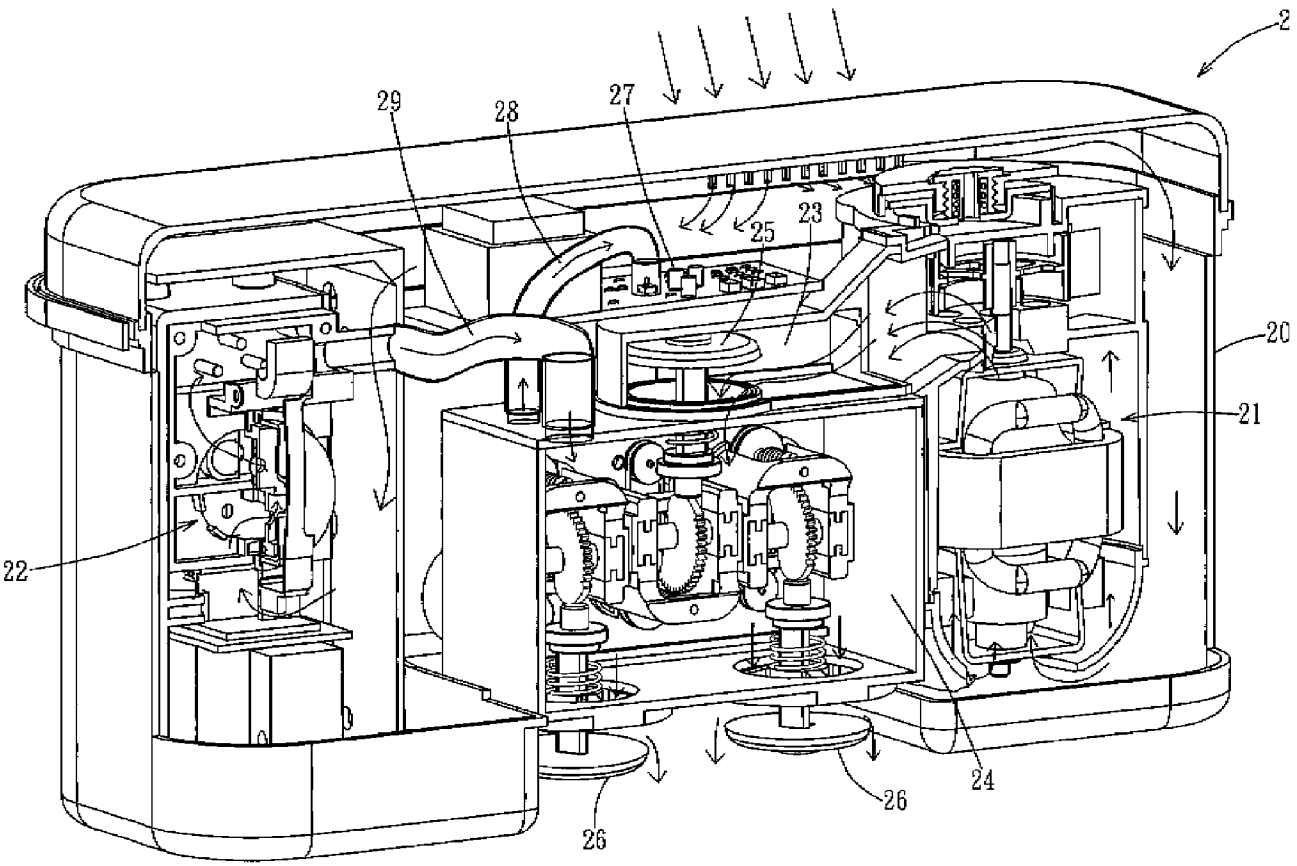
FIG. 4 is an assembled perspective view of an electric air pump unit of the first preferred embodiment.

With particular reference to FIG. 4, in this embodiment, the electrical air pump unit 2 includes a housing 20, a centrifugal pump device 21, a solenoid-operated diaphragm pump device 22, a first transfer chamber 23 formed in the housing 20 and in fluid communication with the centrifugal pump device 21, a second transfer chamber 24 formed in the housing 20 and in fluid communication with the first transfer chamber 23, a first control valve 25 biased to a close position and operable to move to an open position so as to allow for fluid communication between the first and second transfer chambers 23, 24, two second control valves 26 each biased to a close position and operable to move to an open position so as to allow for fluid communication between the second transfer chamber 24 and a respective one of the large and small air chambers (E', E") in the mattress assembly 1', and a pressure sensor 27 in fluid communication with the second transfer chamber 24 via a sensor-connecting conduit 28.

It is noted that the centrifugal pump device 21 provides a smaller thrust for forcing air to flow at a higher flow rate, while the diaphragm pump device 22 provides a greater thrust for forcing air to flow at a slower flow rate. To promote the efficiency of the electrical air pump unit 2 to inflate fully a selected one of the large and small air chambers (E', E"), the centrifugal pump device 21 is first operated until the selected one of the large and small air chambers (E', E") is expanded to about 90% of its full-inflated volume. Subsequently, the diaphragm pump device 22 is operated to inflate the selected one of the large and small air chambers (E', E") fully. To inflate the selected one of the large and small air chambers (E', E"), the centrifugal pump device 21 is activated, and the first control valve 25 and the corresponding second control valve 26 are opened. Hence, air is drawn into the centrifugal pump device 21, and is then forced into the selected one of the large and small air chambers (E', E") via the first and second transfer chambers 23, 24. When the pressure sensor 27 detects that the air pressure in the second transfer chamber 24 reaches a first preset pressure value, e.g., 420 mmHG, it emits a signal to a controller 5 (see FIG. 7) via an electrical wire 7 (see FIG. 7). When the controller 5 receives the signal, it deactivates the centrifugal pump device 21, closes the first control valve 25, and activates the diaphragm pump device 22 to force air into the second transfer chamber 24 via a pump-connecting conduit 29 until the pressure sensor 27 detects that the air pressure in the second transfer chamber 24 reaches a second preset pressure value to complete a full inflation of the selected one of the large and small air chambers (E', E").

Figure 5:
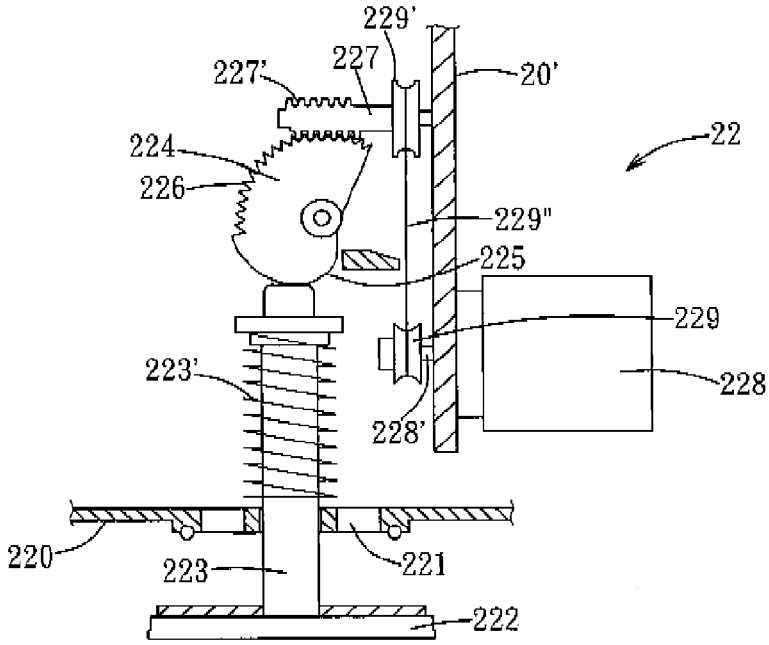
FIG. 5 is a partly sectional side view of a solenoid-operated diaphragm device of the electrical air pump unit of the second preferred embodiment, illustrating a diaphragm valve in an opened state.
Figure 6:
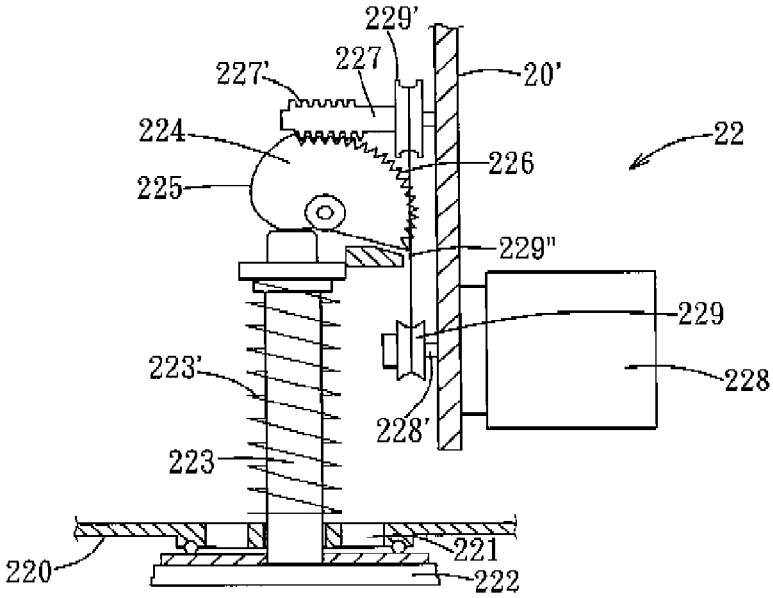
FIG. 6 is a view similar to FIG. 5 but illustrating the diaphragm valve in a closed state.

With further reference to FIGS. 5 and 6, the diaphragm pump device 22 includes a valve seat 220 formed with a valve hole 221, a diaphragm valve 222, a valve rod 223 connected fixedly to the diaphragm valve 222, a coiled compression spring 223' for biasing the diaphragm valve 222 to close the valve hole 221 in the valve seat 220, and a driving unit for moving the valve rod 223. The driving unit includes a pivotable cam member 224 having a cam surface 225 and a sector gear portion 226, a driving rod 227 having a threaded portion 227' engaging the sector gear portion 226, a motor 228 having a motor shaft 228', and a transmission unit 229 interconnecting the motor 228 and the driving rod 227. The valve rod 223 is biased by the compression spring 223' to contact the cam surface 225 of the cam member 224. The driving rod 227 and the motor shaft 228' are journalled on a mounting wall 20' of the housing 20. The transmission unit includes a driving pulley 229 sleeved fixedly on the motor shaft 228', a driven pulley 229' sleeved fixedly on the driving rod 227, and a transmission belt 229" trained on the driving pulley 229 and the driven pulley 229'.

Figure 7:
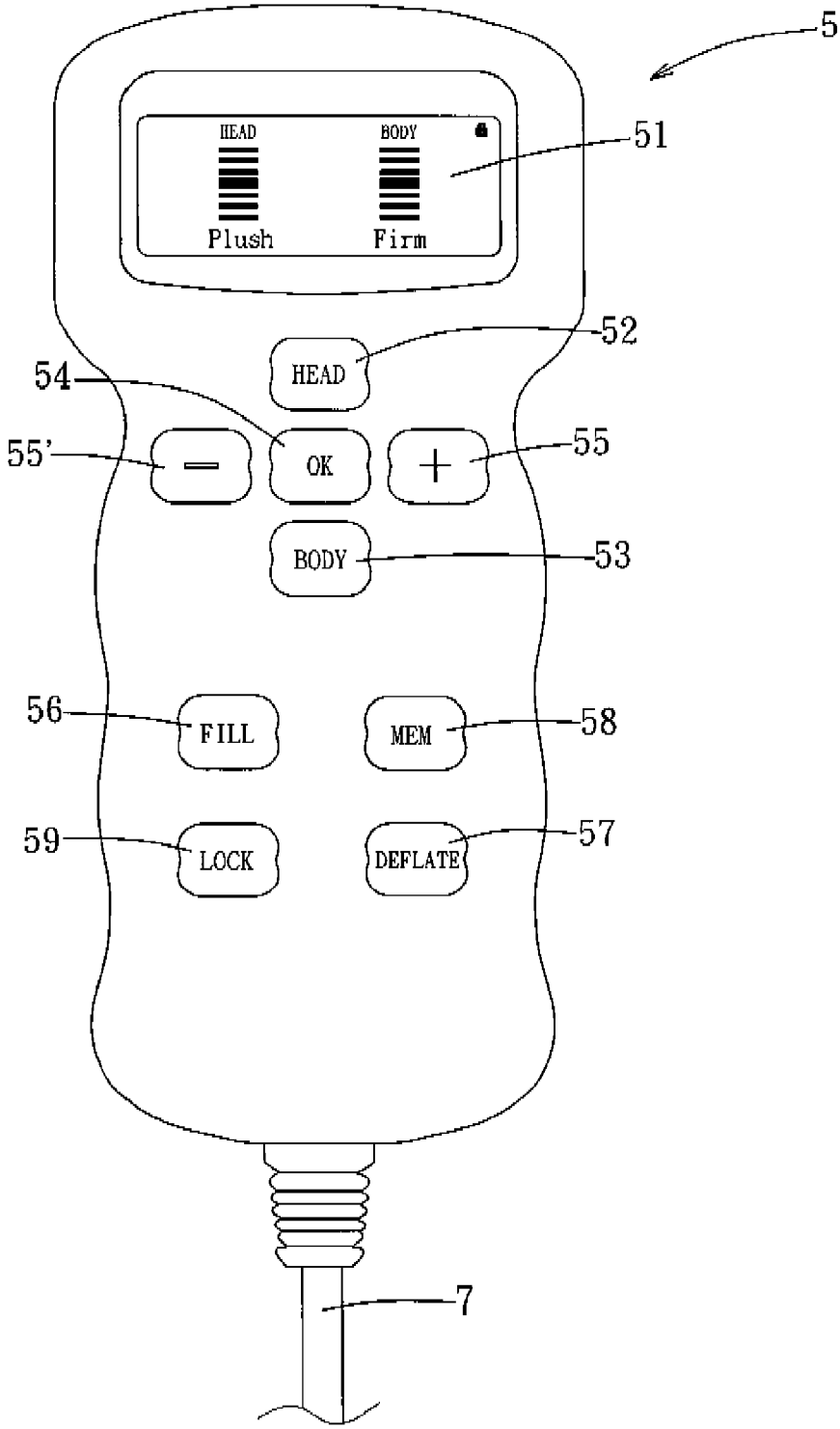
FIG. 7 is a schematic view of a controller of the second preferred embodiment.
Figure 8:
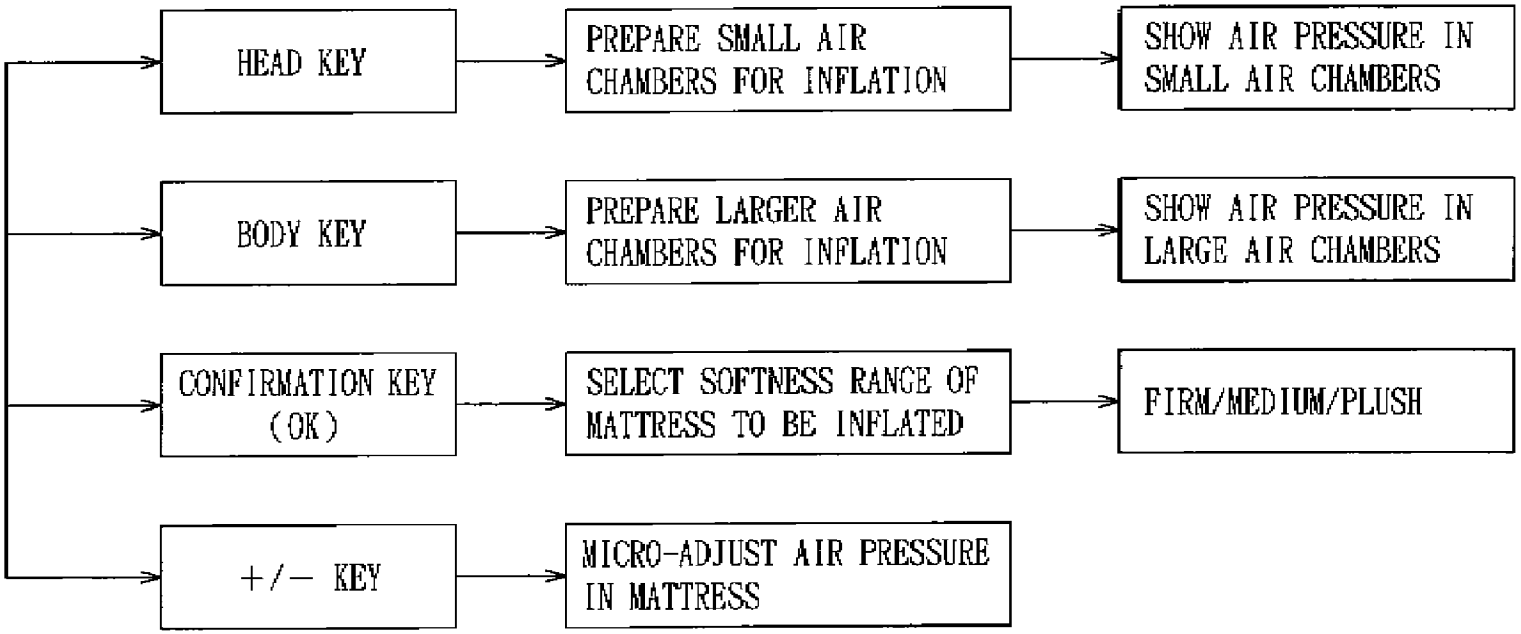
FIG. 8 is a flowchart illustrating operations of the second preferred embodiment in response to pressing of a head key, a body key, a confirmation key, a micro-adjustment inflation key, and a micro-adjustment deflation key, respectively.
Figure 9:
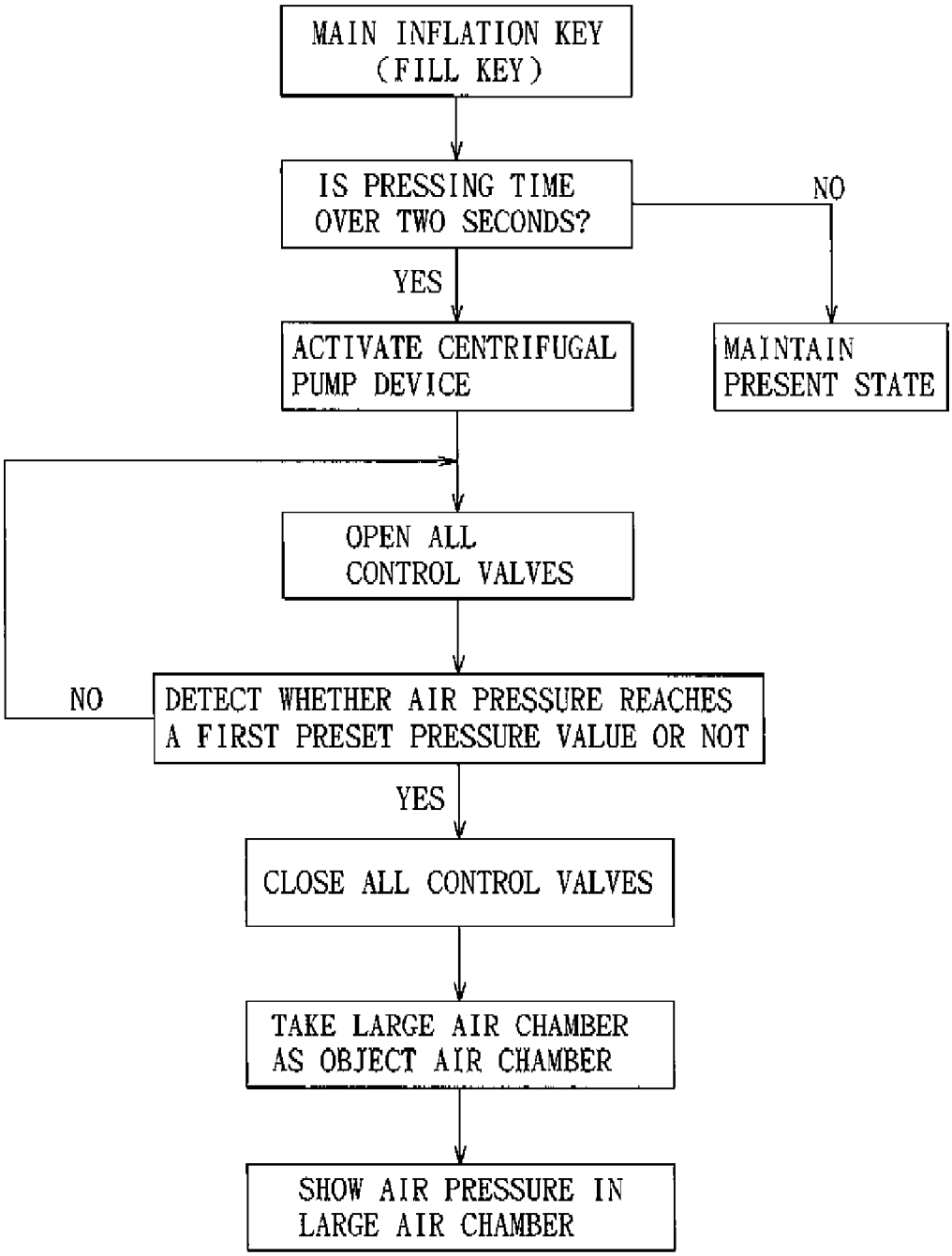
FIG. 9 is a flowchart illustrating operation of the second preferred embodiment in response to pressing of a main inflation key.
Figure 10:
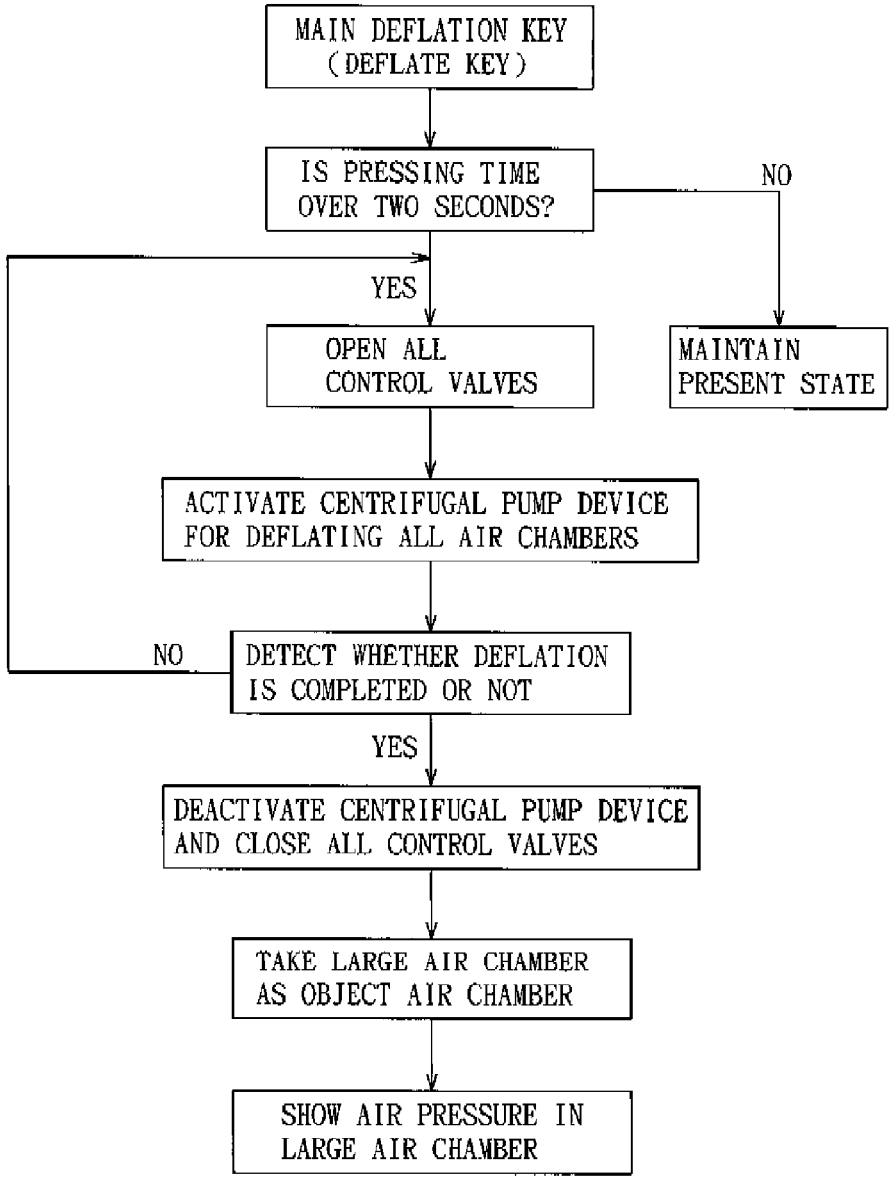
FIG. 10 is a flowchart illustrating operation of the second preferred embodiment in response to pressing of a deflation key.
Figure 11:
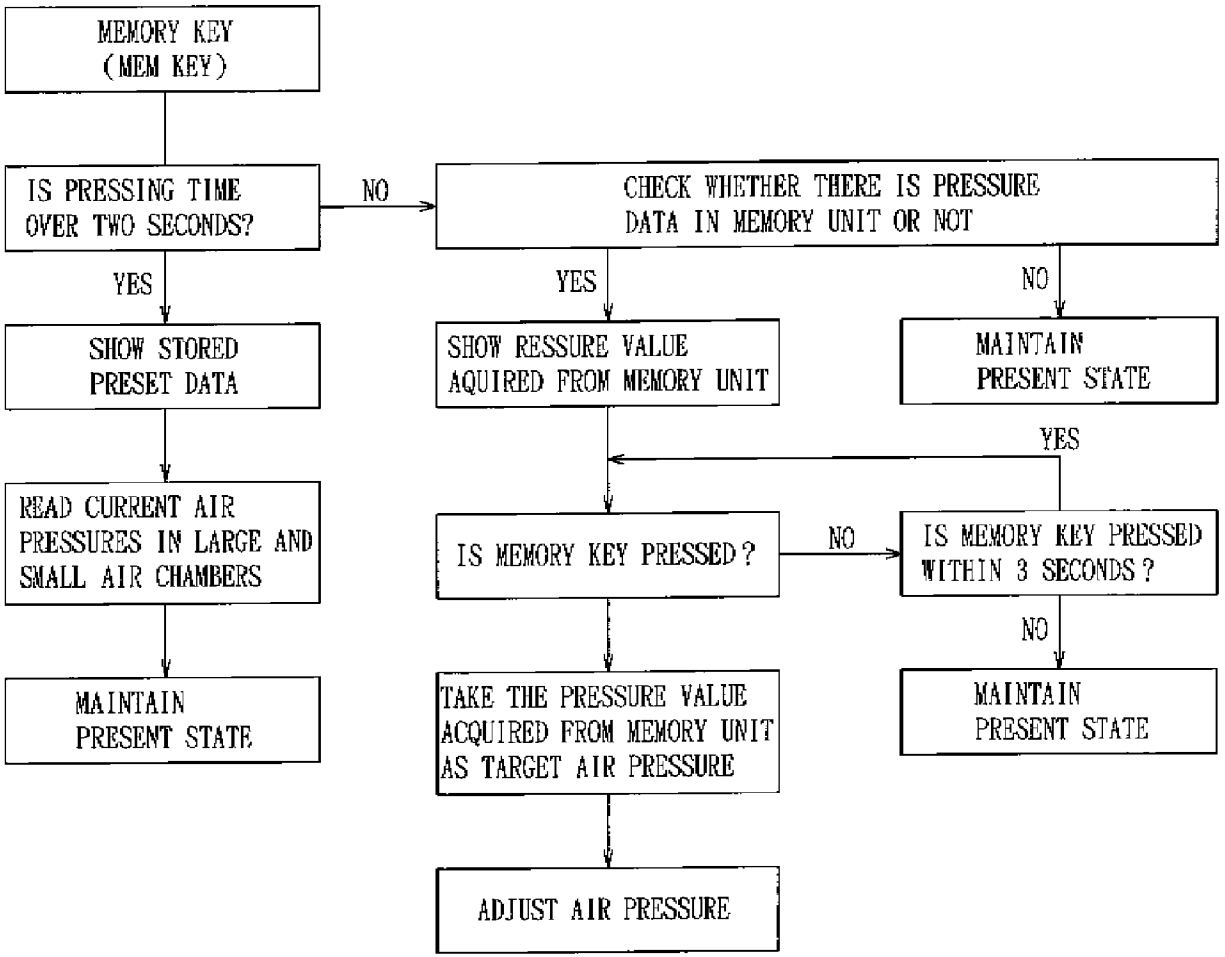
FIG. 11 a flowchart illustrating operation of the second preferred embodiment in response to pressing of a memory key.
Figure 12:
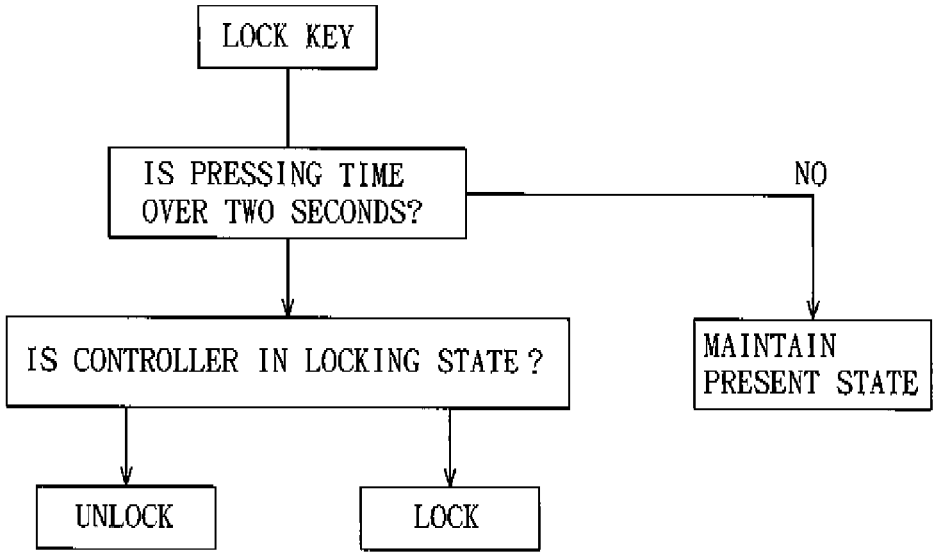
FIG. 12 is a flowchart illustrating operation of the second preferred embodiment in response to pressing of a lock key.

With further reference to FIG. 7, the controller 5 includes a display 51, a head key 52, a body key 53, a confirmation key 54, a micro-adjustment inflation key 55, a micro-adjustment deflation key 55', a main inflation key 56, a main deflation key 57, a memory key 58, and a lock key 59. The operations of the keys 52, 53, 54, 55, 55', 56, 57, 58, 59 are outlined in FIGS. 8, 9, 10, 11, and 12.

When it desired to inflate the mattress 1, the main inflation key 56 is first pressed to inflate the large and small air chambers (E', E") to the first preset pressure value through operation of the centrifugal pump device 21. Next, a selected one of the head key 52 and the body key 53 is pressed, and subsequently, the confirmation key 54 is operated to select the softness of the selected one of the large and small mattresses 10, 10'. During operation of the confirmation key 54, the word "FIRM" is shown in the display 51 when the confirmation key 54 is pressed for the first time, the word "MEDIUM" is shown in the display 51 when the confirmation key 54 is pressed for the second and the word "PLUSH" is shown in the display 51 when the confirmation key 54 is pressed for the third time. Thereafter, if necessary, the micro-adjustment inflation key 55 or the micro-adjustment deflation key 55' can be pressed to micro-adjust the air pressure in the selected one of the large and small mattresses 10, 10' through operation of the diaphragm pump device 22. When "FIRM" is selected during operation of the confirmation key 54, the selected one of the large and small air chambers (E', E") can be inflated fully.

When it is desired to deflate a selected one of the large and small mattresses 10, 10', a corresponding one of the head key 52 and the body key 53 is pressed to open the first control valve 25 and the corresponding second control valve 26 to thereby allow air to flow from the selected one of the large and small mattresses 10, 10' out of the housing 20 via the first control valve 25 and the centrifugal pump device 21.

When it is desired to increase the softness of a selected one of the large and small mattresses 10, 10', the corresponding one of the head key 52 and the body key 53 is pressed, and the micro-adjustment deflation key 55' is operated. When the micro-adjustment deflation key 55' is pressed, the first control valve 25 and the corresponding second control valve 26 are opened to allow for outflow of air from the selected one of the large and small mattresses 10, 10'. When the micro-adjustment deflation key 55' is released, the first control valve 25 and the corresponding second control valve 26 are closed.

When it is desired to change the first preset pressure value, the memory key 58 is operated.

The control panel 5 can be converted between locked and unlocked states through pressing of the lock key 59. In the locked state, when any of the remaining keys 52, 53, 54, 55, 55', 56, 57, 58 is pressed (e.g., unintentionally), no operation is executed and the mattress assembly 1 remains in its present state.

Figure 13:
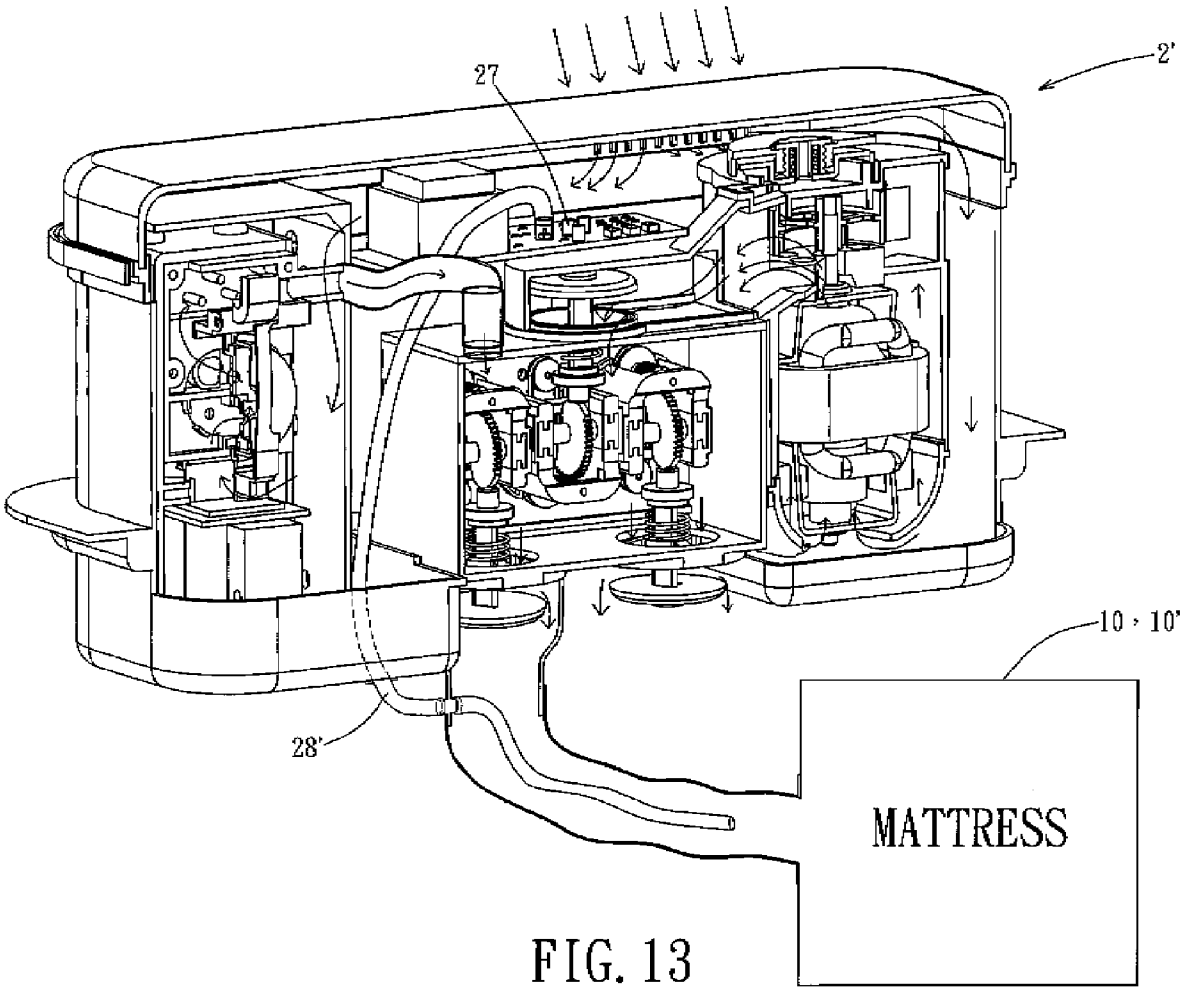
FIG. 13 is a schematic view illustrating a modified electrical air pump unit.

FIG. 13 shows a modified air pump unit 2', which is similar in construction to the electrical air pump unit 2 (see FIG. 4) except that the pressure sensor 27 is in fluid communication with the large and small mattresses 10, 10' through two mattress-connecting conduits 28' (only one is shown), respectively. As such, the air pressures in the large and small mattresses 10, 10' can be measured accurately.

Figure 14:
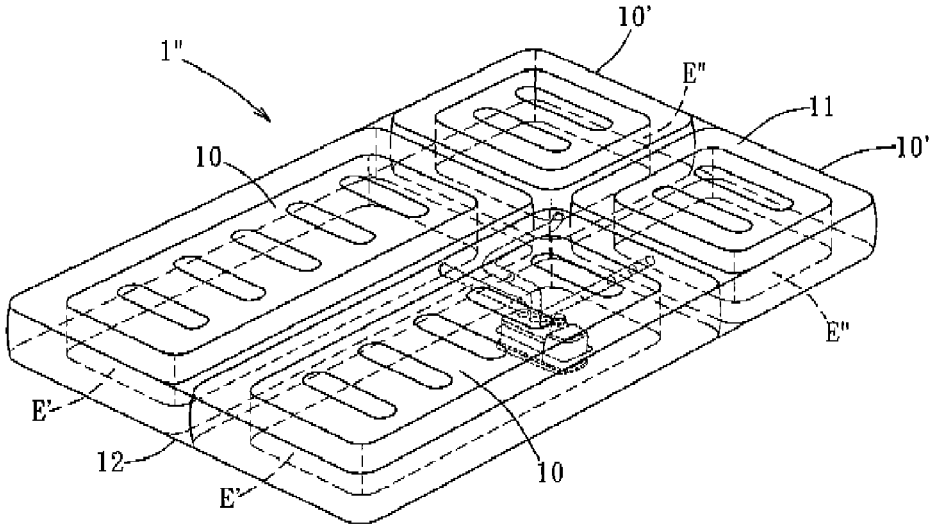
FIG. 14 is an assembled perspective view of a mattress assembly of the third preferred embodiment of an inflatable bed according to this invention.

Referring to FIG. 14, the third preferred embodiment of this invention is similar in construction to the second preferred embodiment. In this embodiment, a second modified mattress assembly 1" includes four surrounding sheets (not shown) and four reinforcing units (not shown), and the control panel includes a pair of left and right head keys (not shown) for replacing the head key 52 (see FIG. 7), and a pair of left and right body keys (not shown) for replacing the body key 53 (see FIG. 7). The top and bottom sheets 11, 12 cooperate with the surrounding sheets to define two juxtaposed large air chambers (E') and two juxtaposed small air chambers (E"). The large and small air chambers (E', E") are arranged in a matrix. The reinforcing units are disposed respectively within the large and small air chambers (E', E"). The surrounding sheets are disposed respectively around the reinforcing units. As such, the mattress assembly 1" has two large mattresses 10 and two small mattresses 10'. Each of the large and small mattresses 10, 10' includes a respective one of the surrounding sheets, and defines a respective one of the large and small air chambers (E', E"). Each aligned pair of the large and small mattresses 10, 10' may be used to support the body and head of one person respectively. Stated differently, the mattress assembly 1" can support two people.

Figure 15:
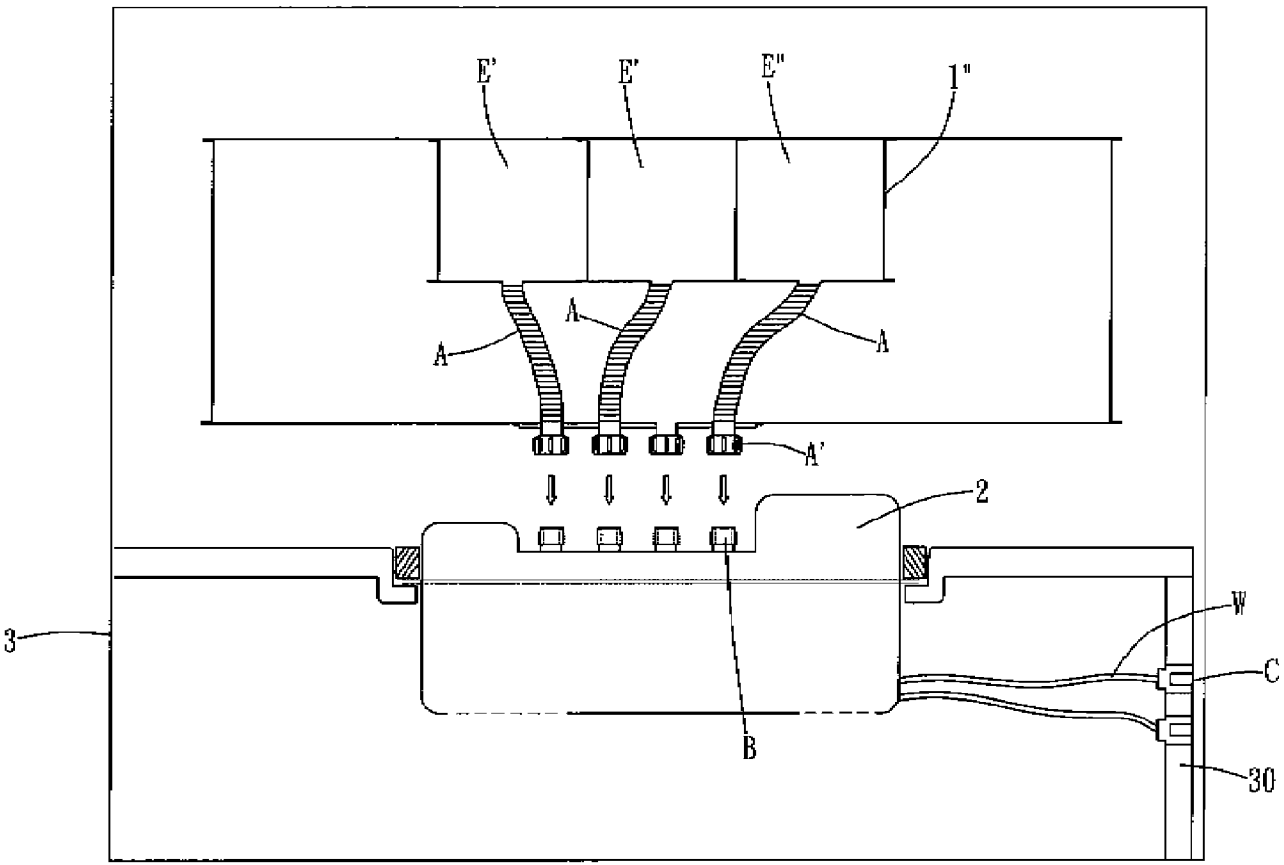
FIG. 15 is a schematic view illustrating a connection between the mattress assembly and an electric air pump unit of the third preferred embodiment.

In this embodiment, with additional reference to FIG. 15, the mattress assembly 1" includes four air conduits (A) (only three are shown) in fluid communication with the large and small air chambers (E', E") (only three are shown), respectively. Each of the air conduits (A) has an internally threaded connecting end (A'). The electrical air pump unit 2 includes four externally threaded connecting members (B) engaging respectively and threadably the connecting ends (A') of the air conduits (A) of the mattress assembly 1". An electrical socket unit (C) is disposed on a sidewall 30 of the bedstead assembly 3. An electrical wire unit (W) interconnects electrically the electrical socket unit (C) and the electrical air pump unit 2.

In view of the above, the softness of the mattress assembly 1" of this invention may be different in different positions to enhance user comfort.

With this invention thus explained, it is apparent that numerous modifications and variations can be made without departing from the scope and spirit of this invention. It is therefore intended that this invention be limited only as indicated by the appended claims.

We Claim

1. An inflatable bed comprising:

a mattress assembly having at least one air chamber; and an electric air pump unit in connection with said mattress assembly and including:

a first pump device in fluid communication with said air chamber in said mattress assembly for inflating said air chamber, a first control valve operable to allow for and interrupt fluid communication between ambient air and said air chamber, said first control valve being disposed between ambient air and said air chamber, a second pump device in fluid communication with said air chamber fluidly separate from said first control valve for inflating said air chamber, an air pressure sensor in fluid communication with said air chamber, and a controller;

said controller being configured to control said first control valve to allow for flow of fluid from ambient air into said air chamber therethrough so that said first pump device performs initial inflation of said air chamber to a first pressure value;

said air pressure sensor configured to detect when the first pressure value has been reached; and said controller being configured such that when said air pressure sensor detects the first pressure value has been reached, said controller controls said first control valve to interrupt flow of fluid from ambient air into said air chamber and deactivates said first pump device, wherein said second pump device is operable to perform subsequent inflation of said air chamber to a second pressure value.

2. The inflatable bed as recited in claim 1, wherein said controller activates said second pump device when said air pressure sensor detects the first pressure value has been reached and inflates said air chamber until said air pressure sensor detects the second pressure value has been reached.

3. The inflatable bed as recited in claim 1, wherein said second pump device is manually operable to inflate said air chamber to the second pressure value.

4. The inflatable bed as recited in claim 1, wherein said first pump device is a centrifugal pump.

5. The inflatable bed as recited in claim 4, wherein said second pump device is a diaphragm pump.

* * * * *